US007984629B2

(12) United States Patent
Xiaobin

(10) Patent No.: US 7,984,629 B2
(45) Date of Patent: Jul. 26, 2011

(54) SECURITY DEVICE

(75) Inventor: Liu Xiaobin, Hangzhou (CN)

(73) Assignee: Hang Zhou Century Plastic and Electronic Co., Ltd., Hangzhou (CN)

( * ) Notice: Subject to any disclaimer, the term of this patent is extended or adjusted under 35 U.S.C. 154(b) by 596 days.

(21) Appl. No.: 11/989,809

(22) PCT Filed: Dec. 19, 2005

(86) PCT No.: PCT/IB2005/003983

§ 371 (c)(1),
(2), (4) Date: Mar. 24, 2008

(87) PCT Pub. No.: WO2006/040693

PCT Pub. Date: Apr. 20, 2006

(65) Prior Publication Data

US 2010/0101283 A1 Apr. 29, 2010

(30) Foreign Application Priority Data

Aug. 9, 2005 (CN) ..... 2005 2 0013900 U

(51) Int. Cl.
*E05B 73/00* (2006.01)
*E05B 65/00* (2006.01)

(52) U.S. Cl. ..... 70/57; 70/49; 70/57.1; 242/382

(58) Field of Classification Search ..... 70/18, 30, 70/49, 57, 57.1, 58, 233; 242/382, 382.5, 242/384.7, 388, 396.2, 396.4
See application file for complete search history.

(56) References Cited

U.S. PATENT DOCUMENTS

| | | | | |
|---|---|---|---|---|
| 1,582,444 | A | 4/1926 | Barts | |
| 4,543,806 | A | 10/1985 | Papandrea et al. | |
| 5,144,821 | A * | 9/1992 | Ernesti et al. | 70/159 |
| 5,598,727 | A * | 2/1997 | White | 70/233 |
| 5,794,464 | A * | 8/1998 | Yeager et al. | 70/57 |
| 5,960,652 | A * | 10/1999 | Marmstad | 70/49 |
| 6,092,401 | A * | 7/2000 | Sankey et al. | 70/57.1 |
| 6,550,293 | B1 * | 4/2003 | Delegato et al. | 70/59 |
| 7,162,899 | B2 * | 1/2007 | Fawcett et al. | 70/57.1 |
| 7,168,275 | B2 * | 1/2007 | Fawcett et al. | 70/57.1 |
| 7,685,850 | B2 * | 3/2010 | Nilsson | 70/57.1 |
| 2006/0137409 | A1 | 6/2006 | Fawcett et al. | |
| 2006/0137411 | A1 | 6/2006 | Fawcett et al. | |

(Continued)

FOREIGN PATENT DOCUMENTS

EP 1870547 A1 * 12/2007

(Continued)

*Primary Examiner* — Suzanne D Barrett
*Assistant Examiner* — Christopher Boswell
(74) *Attorney, Agent, or Firm* — Drinker Biddle & Reath LLP

(57) ABSTRACT

A security device for deterring theft of an object from a retail store has a base member, a cable for placement about the object, and a spool rotatably mounted on the base member. The cable is connected to the spool such that the cable can be wound around the spool, enabling the cable to be tightened around the object by rotating the spool with respect to the base member in a tightening direction. There is a ratchet and pawl mechanism configurable between an active configuration wherein the spool is constrained for rotation only in the cable tightening direction, and an inactive configuration whereby the spool is free to rotate in both the cable tightening direction and an opposite, cable loosening direction.

12 Claims, 7 Drawing Sheets

U.S. PATENT DOCUMENTS

2006/0169008 A1 8/2006 Fawcett et al.
2007/0039360 A1 2/2007 Fawcett et al.
2007/0069529 A1* 3/2007 Nilsson ..... 292/315
2007/0101775 A1* 5/2007 Fawcett et al. ..... 70/57.1
2007/0107477 A1* 5/2007 Fawcett et al. ..... 70/57.1

FOREIGN PATENT DOCUMENTS

WO WO9719241 A1 5/1997

* cited by examiner

SECURITY DEVICE

The invention relates to a security device for preventing tampering with and/or theft of objects from a retail store.

Goods on the open shelves of a retail store, such as a supermarket are often illegally opened or taken away. This is a particular problem with high value electrical goods.

In order to deter theft, it is known to attach an electronic article surveillance tag or label (hereinafter referred to as EAS tags) to the product or to the packaging thereof.

One type of commonly used EAS tag, known as a "hard tag", is adapted to trigger an alarm or the like if the product is removed from the store and the EAS tag has not been deactivated or removed from the product.

Typically, a hard tag comprises a tag body and a tack. The tag body is typically made of rigid plastic and houses an EAS sensor. The tack has a sharp end that is adapted to pierce the object being protected or the packaging thereof and then is adapted to be inserted into the interior of the tag body. A mechanism, which may include a magnetic or mechanical clamp, is typically housed within the tag body and is used to retain the sharp end of the tack within the tag body, thereby preventing the hard tag from being removed from the object or the packaging thereof.

A shortcoming with tags of the type described above is that the pointed end of the tack must be inserted through the object or object packaging in order for the tag to be secured thereto. As can readily be appreciated, the insertion of the pointed end of the tack through the object may damage certain types of product.

A further shortcoming with such known hard tags is that the tag cannot prevent the unauthorised opening of the object packaging and removal of the object or components of the object therefrom, particularly where boxes or box-like packaging is used, as is common in electronic goods and other high value complex products.

It is known to provide lockable cases to enclose an object, such as a music CD. However, such cases are specific to one size of object and thus are unsuitable in situations wherein a large range of different sized objects are stocked.

EP 0 862 677 discloses an attempt to overcome the above-mentioned problems. Such document discloses a security device wherein the device is secured to an object by means of cables that can be, wrapped around an object and/or the packaging thereof, the device including a winding mechanism whereby the cables can be tightened and secured around the object. The device prevents opening of the packaging and can be provided with an EAS tag to deter unauthorised removal of the object from a store. A two piece locking member is provided to which the cables are attached. Such locking member is separate from the winding mechanism and permits removal of the device from the object at the checkout by use of a special unlocking tool or key.

However, such known device has a number of disadvantageous shortcomings. Firstly, a special tool, in the manner of a key, is required to operate the winding mechanism to attach the device to a product. Such tool may be prone to loss, rendering the device unusable. Furthermore, an additional special tool or key is required to detach the device from the object at the checkout. Such tool is different from those commonly required to remove standard hard tags and thus provides added cost and complexity at the checkout station.

According to the present invention there is provided a security device for deterring theft of an object from a retail store, said device comprising a base member, cable means for placement about the object, spool means rotatably mounted on the base member, the cable means being connected to the spool means such that the cable means can be wound around said spool means enabling said cable means to be tightened around said object upon rotation of the spool means with respect to the base member in a tightening direction, and a ratchet and pawl mechanism configurable between an active configuration wherein the spool means is constrained for rotation only in said cable tightening direction, and an inactive configuration whereby the spool means is free to rotate in both the cable tightening direction and an opposite, cable loosening direction.

Preferably wherein said ratchet and pawl mechanism is biased towards its active configuration.

In a preferred embodiment a trigger element having a cam surface may be provided, said cam surface acting on a portion of said ratchet and pawl mechanism to urge the ratchet and pawl mechanism towards its inactive configuration as the trigger element moves between a first position and a second position. The trigger element is preferably biased towards its second position. Holding means, preferably comprising a locking pin being engageable with a corresponding aperture in said trigger element, maintains said trigger element in its first position. The locking pin may be biased towards its engaged position.

At least part of the locking pin is preferably formed from a magnetic material whereby the locking pin can be urged away from its engaged position by means of a magnetic detacher to release the trigger element, thus placing the ratchet and pawl mechanism it is inactive configuration, enabling rotation of the spool means in its cable loosening direction whereby the device can be detached from said object.

The ratchet and pawl mechanism may comprise a ratchet plate mounted on the spool means having a plurality of ratchet teeth formed on a circular track on an outer surface of the ratchet plate, said ratchet teeth being engageable with corresponding pawl teeth mounted on a circular track provided on a inner surface of a cover portion of said base member, biasing means being provided on the spool means for urging the ratchet teeth of the ratchet into engagement with the pawl teeth of the base member cover portion, the ratchet plate having an outwardly extending cam follower portion engageable with the cam surface of the trigger element.

Preferably the spool means is provided with a plurality of elongate outwardly extending locating pins, said ratchet plate being provided with apertures locatable over said locating pins whereby the ratchet plate can be rotated by corresponding rotation of the spool means. The trigger element may mounted on a cover plate mounted on the spool means for rotation therewith.

Preferred embodiments of the present invention will now be described by way of example only, and with reference to the accompanying drawings in which.

Figure 1:
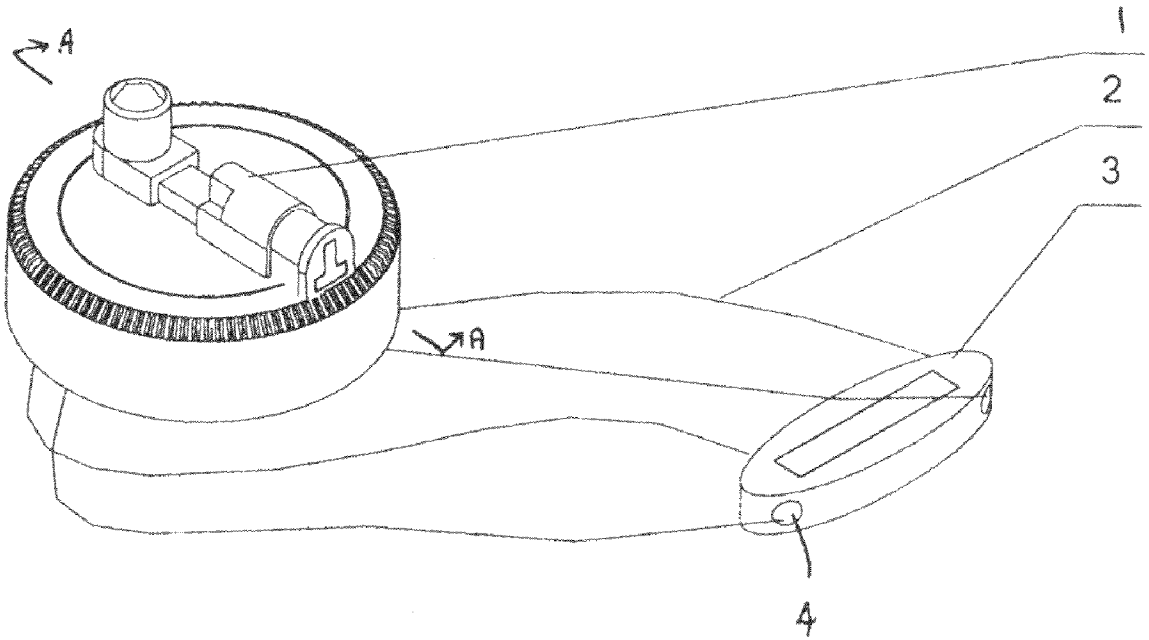
FIG. 1 is a perspective view of a security device according to a first embodiment of the invention.
Figure 6:
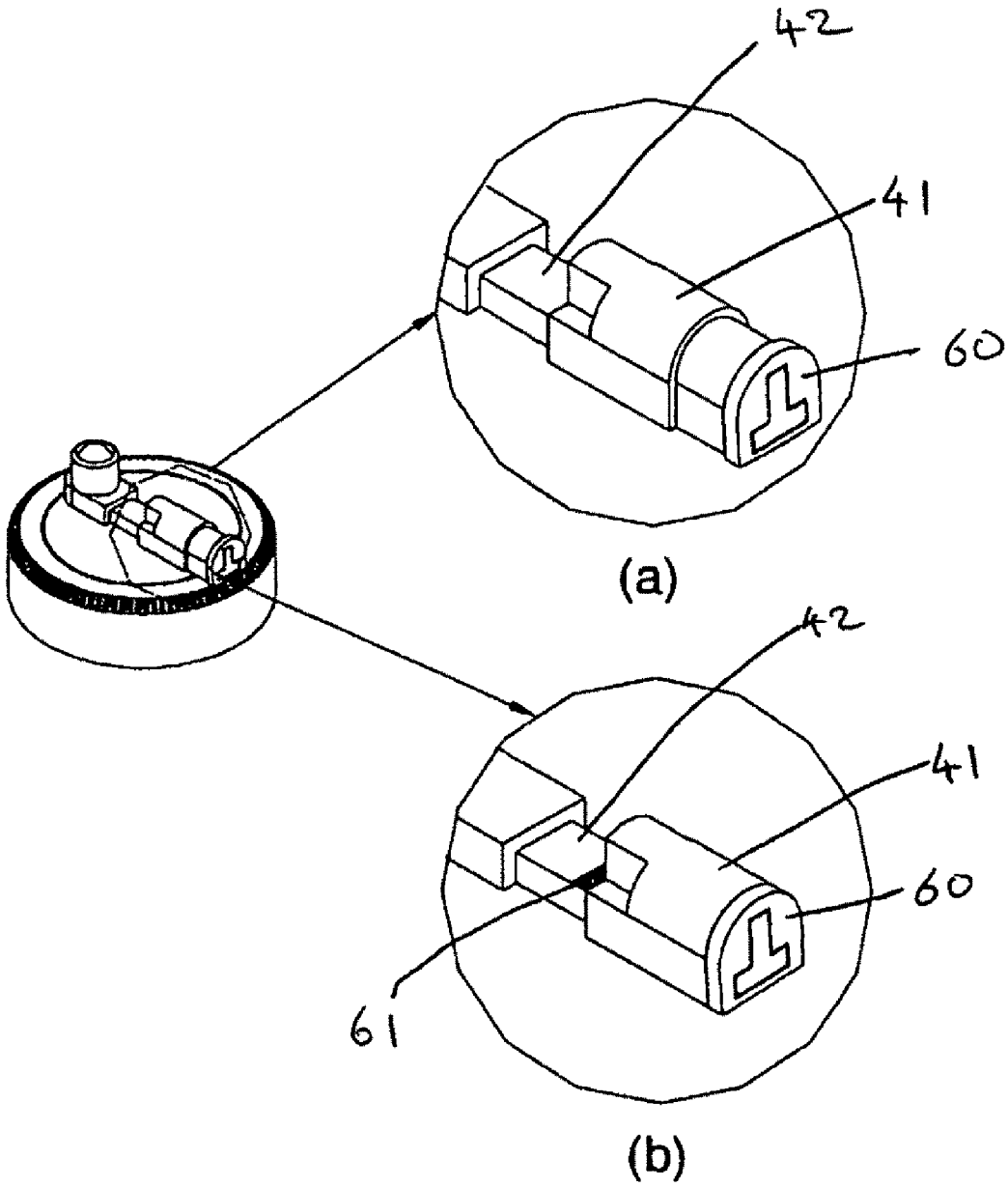
Figure 7:
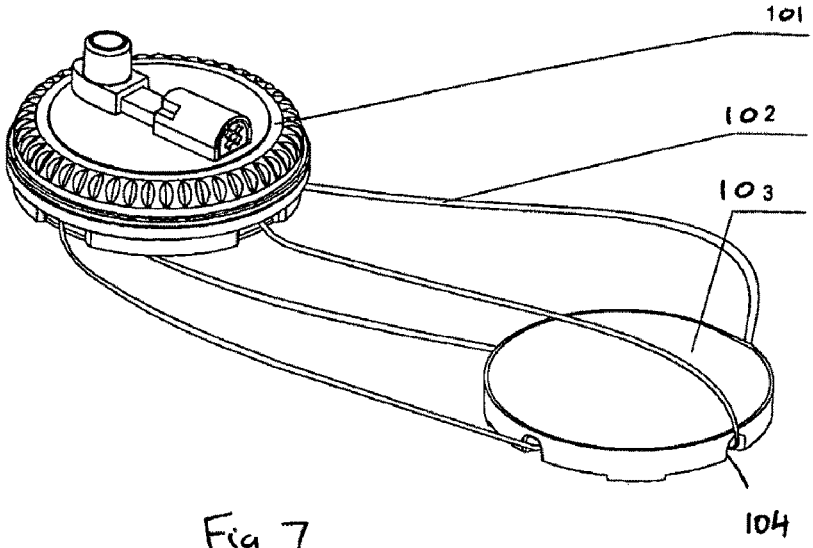
Figure 8:
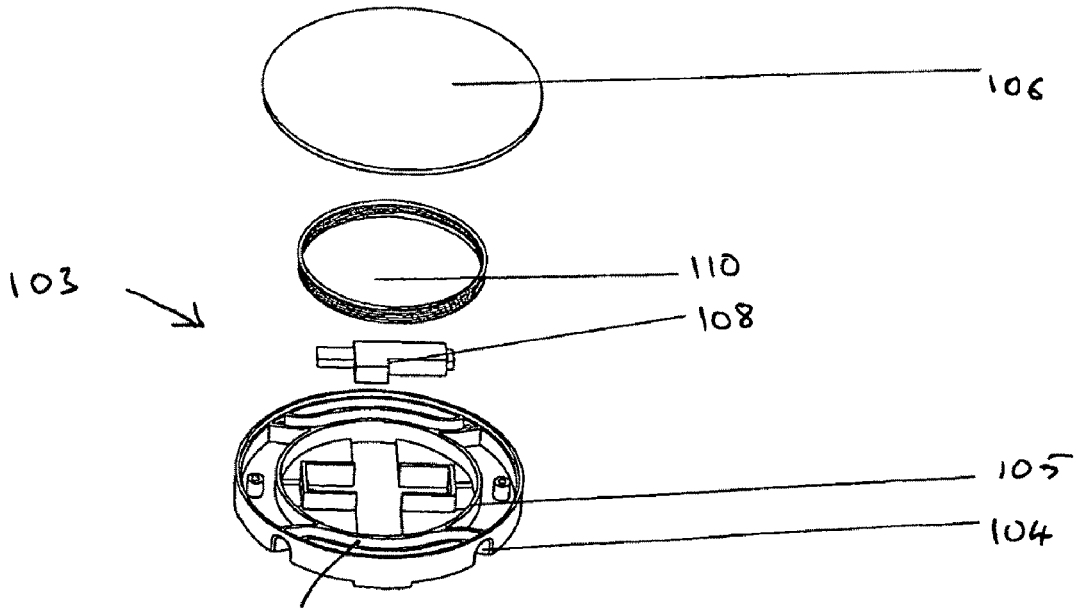

FIG. 6*a* is a view of the trigger element of the device of FIG. 1 when the ratchet and pawl mechanism is in its inactive position;

FIG. 6*b* is a view of the trigger element of the device of FIG. 1 when the ratchet and pawl mechanism is in its active position;

FIG. 7 is a perspective view of a security device according to a second embodiment of the invention; and FIG. 8 is an exploded view of the linking portion of the device of FIG. 7.

Figure 2:
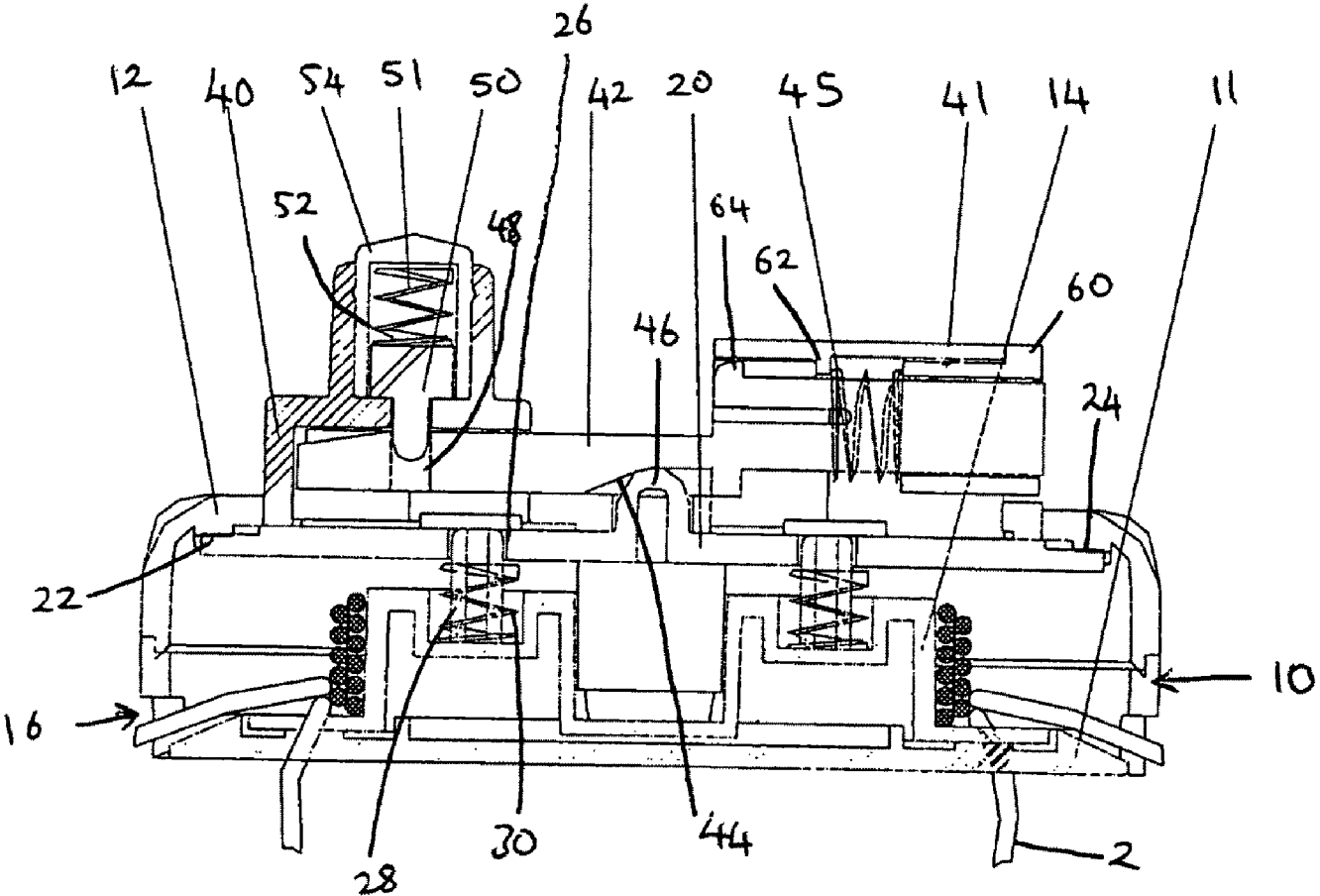
FIG. 2 is a section view of FIG. 1 along A-A with the ratchet and pawl mechanism in its active position.
Figure 3:
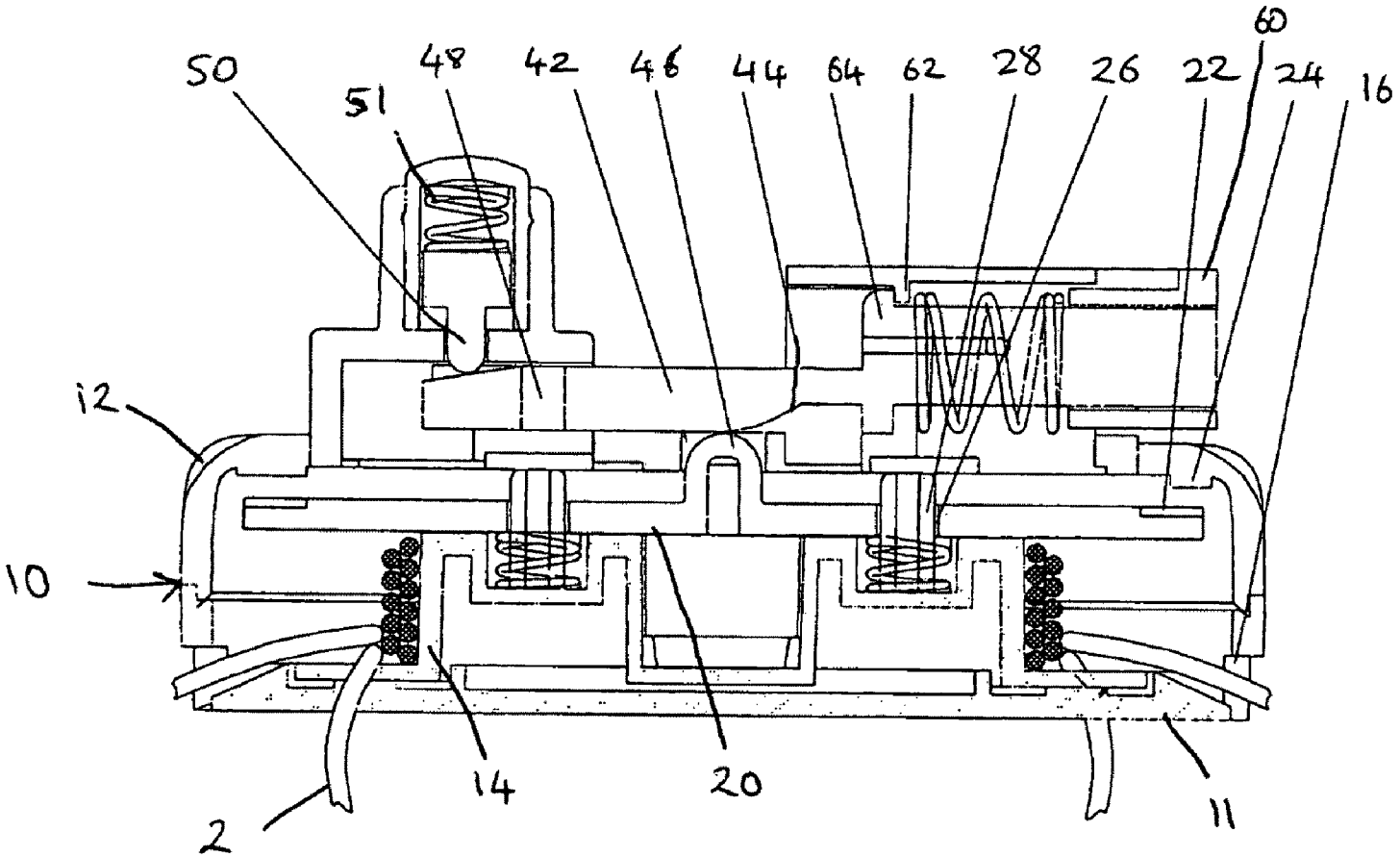
FIG. 3 is a section view of FIG. 1 along A-A with the ratchet and pawl mechanism in its inactive position.

As shown in FIGS. 1 to 6, a security device according to a first embodiment of the present invention comprises a main body 1 and a pair of binding cables 2 extending from the main body 1 and looped through apertures 4 in either end of a linking portion 3 to permit the device to be secured around an object. Any reference to "upper" and "lower" in the following description refer to the orientation of the parts as shown in FIGS. 2 and 3.

As shown in FIGS. 2 and 3, the main body 1 comprises a base member 10 having a lower portion 11 and an upper portion 12 within which is rotatably mounted a spool 14 to which the ends of the cables 2 are attached such that the cables 2 can be wound around the spool 14 to tighten the cables 2 around an object as the spool is rotated with respect to the base member 10 in a tightening direction. The base member 10 is provided with spaced apertures 16 through which the cables 2 pass.

A ratchet and pawl mechanism is provided for selectively controlling the rotation of the spool comprising a ratchet plate 20 having ratchet teeth 22 formed on a peripheral track on the upper surface thereof, the ratchet teeth 22 being engageable with corresponding pawl teeth 24 provided on an inner peripheral edge of the upper portion 12 of the base member 10. The ratchet plate 20 is provided with a pair of spaced apertures 26 locatable over upwardly extending guide posts 28 provided on the spool 14 such that the ratchet plate 20 is rotatably fixed to the spool 14. A coil spring 30 is mounted on each guide post 28 between the spool 14 and the ratchet plate 20 to urge the ratchet plate 20 towards an upper position wherein the ratchet teeth 22 of the ratchet plate 20 engage with the pawl teeth 24 of the base member 10.

An upper cover plate 40 engages corresponding formations on the ratchet plate 20 when in its uppermost position to constrain the cover plate 40 for rotation with the spool 14. An upper surface of the cover plate 40 is provided with a radial guide sleeve 41 in which is received a trigger element 42 slidably moveable within said sleeve 41.

The trigger element 42 has a recessed cam surface 44 formed in a lower region thereof abutting a centrally located upwardly extending cam follower portion 46 formed on the ratchet plate 20 whereby the trigger element 42 is moveable between a first position as shown in FIG. 2, wherein the recessed cam surface 44 permits the ratchet plate 20 to move to its uppermost position wherein the ratchet teeth 22 of the ratchet plate 20 engage with the pawl teeth 24 of the base member 10, and a second position as shown in FIG. 3, wherein the ratchet plate 20 is pushed downwardly to a position wherein the ratchet teeth 22 are spaced and disengaged from the corresponding pawl teeth 24 (and the ratchet plate 20 is disengaged from the cover plate 40). A coil spring 45 is provided within the sleeve 41, biasing the trigger element 42 towards its second position.

One end of the trigger element 42 is provided with an aperture 48 into which is insertable an axially moveable locking pin 50 mounted in a guide bore 52 in the upper cover portion 40 to lock the trigger element 42 in its first position, as shown in FIG. 2. The upper end of the locking pin guide bore 52 is covered by a cap element 54. The locking pin 50 is biased towards its inserted position by means of a spring 41 located within the capping element 54 above the pin 50.

The locking pin 50 is formed from a magnetic material, such as mild steel, such that the locking pin 50 can be urged out of its inserted position to release the trigger element 42 by applying a magnetic field to the upper region of the locking pin 50.

Figure 4:
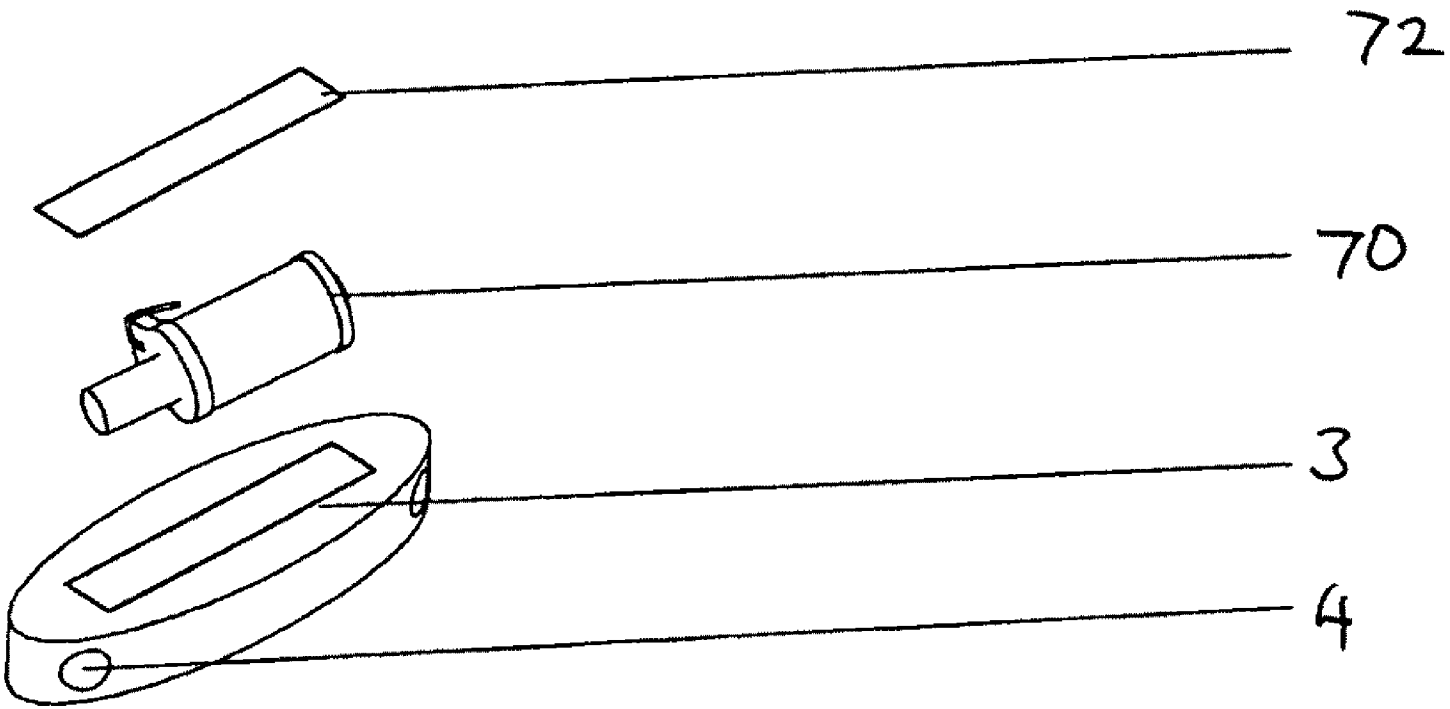
FIG. 4 is an exploded view of the linking portion of the device.

As shown in FIG. 4, an EAS tag 70 can be located within the linking portion 3. The EAS tag 70 can be enclosed by a cover portion 72, which may be transparent.

Figure 5A:
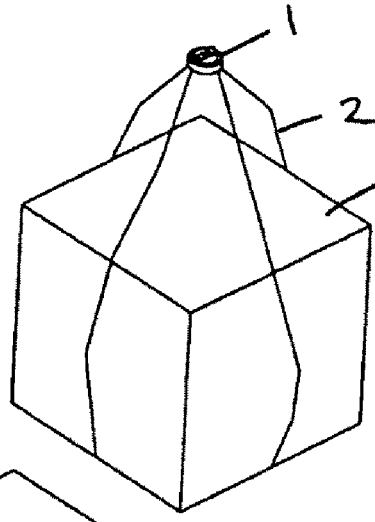
FIGS. 5A to 5C are perspective views of the device placed on a box.

Use of the security device will now be described with reference to FIGS. 5A to 5C.

The device is secured to a boxed object 80 by first placing the object within the cables 2 with the linking portion 3 on one side and the main body 1 on an opposite side of the object 80.

The trigger element 42 is manually pushed to its first position wherein the locking pin 50 enters the aperture 48 under the action of spring 51 to hold the trigger in its first position. By such action, the ratchet plate 20 is permitted to move upwardly under the action of springs 30 as the cam follower 46 slides along the recessed cam surface 44 of the trigger element 42 until the ratchet teeth 22 engage the pawl teeth 24 and the ratchet plate 20 engages the cover plate 40.

Figure 5B:
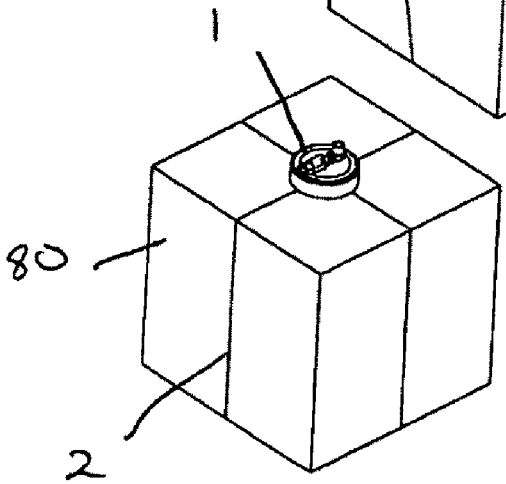
Figure 5C:
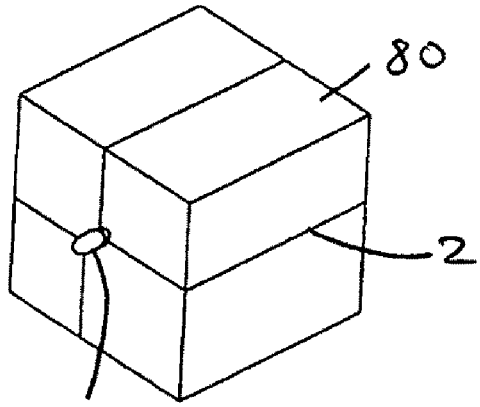

The regions of the upper cover portion 40 defining the guide sleeve 41 and locking pin guide bore 52 can be used as a handle to assist manual rotation of the cover plate 40 and corresponding rotation of the ratchet plate 20 and spool 14 with respect to the base member 10 in a cable tightening direction until the cables 2 are tightly secured around the object 80, as shown in FIGS. 5B and 5C. The interaction of the ratchet teeth 22 of the ratchet plate 20 and the pawl teeth 24 of the upper portion 12 of the base member 10 prevent rotation of the spool 14 with respect to the base member 10 in a loosening direction and thus prevents removal of the device from the object 80.

When it is desired to remove the security device from the object, for example at a store check out counter, the capping element 54 of the locking pin 50 can be inserted into a standard magnetic EAS tag detacher such that the guide pin 50 is pulled out of the aperture 48 in the trigger element 42 by the magnetic field of the detacher. When the guide pin 50 is pulled out of the aperture 48 the trigger element 42 is released to move to its second position under the action of spring 45, whereby the cam surface 44 urges the cam follower 46 downwardly such that the ratchet teeth 22 of the ratchet plate 20 are separated from the pawl teeth 24 of the base means 10 and the ratchet plate 20 is separated from the upper cover plate 40 to permit free rotation of the spool in either direction such that the cables 2 can be unwound from the spool 14 to allow the device to be detached from the object 80.

As shown in FIGS. 6*a* and 6*b*, a section of the trigger element 42 is exposed above the upper cover plate 40. An indicator marking 61 is provided on an upper surface of the trigger element at a position which is obscured by the sleeve 41 when the trigger element 42 is in its second position and exposed when the trigger element is in its first position to indicate when the device is in a state wherein it cannot be removed from the object.

As shown in FIGS. 7 and 8, a security device according to a second embodiment of the present invention comprises a main body 101 and a pair of binding cables 102 extending from the main body 101 and looped through apertures 104 in either end of a linking portion 103 to permit the device to be secured around an object.

The main body 101 of the device according to the second embodiment is identical in construction to that of the first embodiment, comprising a spool upon which the binding cables can be wound, a ratchet and pawl mechanism and a trigger element.

The second embodiment differs from the first in that the linking portion 103 comprising a disc shaped body, substantially larger than the linking portion 3 of the first embodiment to provide greater protection for the binding cables 102, reduce the risk of the binding cables being separated by cutting of the linking portion 103 between apertures and to resist twisting of the binding cables 102.

As shown in FIG. 8, the linking portion 103 comprises a base portion 105 having apertures 104 and guide channels 106.

The base portion 105 has a central region for receiving an EAS tag. As shown in FIG. 8, two separate EAS tags are provided, a ferrite EAS tag 108 for AM detection and a coil type tag 110 for RF detection.

In alternative embodiment (not shown) the base member 10 may be adapted to contain a sounder device, power supply and appropriate circuitry whereby the sounder device can indicate when one of the cables has been cut by providing an audible alarm signal. The cables 2 may be formed from or include electrically conductive wires connected to the circuitry such that the cutting of one of the cables 2 can be detected as a break in circuit continuity.

The actuation of the sounder device may be associated with the trigger mechanism whereby movement of the trigger element to its first position activates the sounder device circuitry, whilst movement of the trigger to its second position to detach the security device switches off the sounder device circuitry to maximise battery life.

An LED may be provided on the main body of the device to show the status of the sounder device. The LED may be adapted to indicate when the batteries require replacement, for example by flashing.

Various modifications and variations to the described embodiments of the inventions will be apparent to those skilled in the art without departing from the scope of the invention as defined in the appended claims. For example, the EAS tag may be provided within the main body of the device rather than in the linking portion. Although the invention has been described in connection with specific preferred embodiments, it should be understood that the invention as claimed should not be unduly limited to such specific embodiments.

The invention claimed is:

1. A security device for deterring theft of an object from a retail store, said device comprising:

a base member;

cable means for placement about the object;

spool means rotatably mounted on the base member, the cable means being connected to the spool means such that the cable means can be wound around said spool means enabling said cable means to be tightened around said object upon rotation of the spool means with respect to the base member in a tightening direction; and a ratchet and pawl mechanism configurable between an active configuration wherein the spool means is constrained for rotation only in said cable tightening direction, and an inactive configuration whereby the spool means is free to rotate in both the cable tightening direction and an opposite, cable loosening direction, said ratchet and pawl mechanism being biased towards its active configuration, wherein the ratchet and pawl mechanism is configured to move from the active configuration to the inactive configuration by applying a magnetic force to a portion of the base member.

2. A security device as claimed in claim 1, wherein said ratchet and pawl mechanism is biased towards its active configuration.

3. A security device as claimed in claim 2, wherein a trigger element having a cam surface is provided, said cam surface acting on a portion of said ratchet and pawl mechanism to urge the ratchet and pawl mechanism towards its inactive configuration as the trigger element moves between a first position and a second position.

4. A security device as claimed in claim 3, wherein the trigger element is biased towards its second position.

5. A security device as claimed in claim 4, wherein holding means is provided for holding the trigger element in its first position.

6. A security device as claimed in claim 5, wherein the holding means comprises a locking pin is engageable with a corresponding aperture in said trigger element to maintain said trigger element in its first position.

7. A security device as claimed in claim 6, wherein said locking pin is biased towards its engaged position.

8. A security device as claimed in claim 7, wherein said at least part of the locking pin is formed from a magnetic material whereby the locking pin can be urged away from its engaged position by means of a magnetic detacher to release the trigger element, thus placing the ratchet and pawl mechanism it is inactive configuration, enabling rotation of the spool means in its cable loosening direction whereby the device can be detached from said object.

9. A security device as claimed in claim 3, wherein the ratchet and pawl mechanism comprises a ratchet plate mounted on the spool means having a plurality of ratchet teeth formed on a circular track on an outer surface of the ratchet plate, said ratchet teeth being engageable with corresponding pawl teeth mounted on a circular track provided on a inner surface of a cover portion of said base member, biasing means being provided on the spool means for urging the ratchet teeth of the ratchet into engagement with the pawl teeth of the base member cover portion, the ratchet plate having an outwardly extending cam follower portion engageable with the cam surface of the trigger element.

10. A security device as claimed in claim 9, wherein the spool means is provided with a plurality of elongate outwardly extending locating pins, said ratchet plate being provided with apertures locatable over said locating pins whereby the ratchet plate can be rotated by corresponding rotation of the spool means.

11. A security device as claimed in claim 10, wherein the trigger element is mounted on a cover plate mounted on the spool means for rotation therewith.

12. A security device for deterring theft of an object from a retail store, said device comprising:

a base member;

cable means for placement about the object;

spool means rotatably mounted on the base member, the cable means being connected to the spool means such that the cable means can be wound around said spool means enabling said cable means to be tightened around said object upon rotation of the spool means with respect to the base member in a tightening direction; and a ratchet and pawl mechanism in the base member configurable between an active configuration wherein the spool means is constrained for rotation only in said cable tightening direction, and an inactive configuration whereby the spool means is free to rotate in both the cable tightening direction and an opposite, cable loosening direction, said ratchet and pawl mechanism being biased towards its active configuration, and wherein the ratchet and pawl mechanism is configured to move from the active configuration to the inactive configuration by applying a magnetic field to the base member.

* * * * *